US006036359A

United States Patent [19]

Pantet

[11] Patent Number: 6,036,359

[45] Date of Patent: Mar. 14, 2000

[54] BRACELET-WATCH WHEREIN THE BRACELET IS ATTACHED TO THE WATCH BY A TIE

[75] Inventor: Laurent Pantet, Nods, Switzerland

[73] Assignee: The Swatch Group Management Services AG, Biel, Switzerland

[21] Appl. No.: 09/210,367

[22] Filed: Dec. 14, 1998

[30] Foreign Application Priority Data

Dec. 18, 1997 [CH] Switzerland ..... 2913/97

[51] Int. Cl.[7] ..... A44C 5/00; G04B 37/00

[52] U.S. Cl. ..... 368/281

[58] Field of Search ..... 368/281, 282; 224/164, 175

[56] References Cited

U.S. PATENT DOCUMENTS 4,706,857 11/1987 Aellen et al. .

FOREIGN PATENT DOCUMENTS 0 167 891 1/1985 European Pat. Off. .

2 036 330 1/1970 France .

394 676 12/1965 Switzerland .

490 827 7/1970 Switzerland .

*Primary Examiner*—Vit Miska

*Attorney, Agent, or Firm*—Griffin, Butler, Whisenhunt & Szipl, LLP

[57] ABSTRACT

The bracelet-watch comprises a case (1) including a back cover (2), a crystal (3) and a middle part (4) surrounding a movement (5) and two bracelet portions (6, 7) attached to the case, each portion being made by means of links (8) articulated one after the other via cylindrical bars (9) inserted between the links, the links (8) and the bars (9) of each of the portions (6, 7) being held together by a flexible tie (10) which passes through them, this tie attaching said portion to said middle part, characterized in that the tie (10) is fixed via its first end (11) to a final link (12) of the bracelet portion to pass first, into first holes (13, 14), through the links and bars constituting said portion and in that the tie (10) then passes into the middle part (4) then comes out again to pass finally, into second holes (15, 16), through the same links (8) and bars (9) in order to be fixed, via its second end (17), to said final link (12) of said bracelet portion.

5 Claims, 4 Drawing Sheets

BRACELET-WATCH WHEREIN THE BRACELET IS ATTACHED TO THE WATCH BY A TIE

The present invention concerns a bracelet-watch comprising a case including a back cover, a crystal and a middle part surrounding a movement and two bracelet portions attached to the case, each portion being made by means of links articulated one after the other via cylindrical bars inserted between the links, the links and the bars of each of the portions being held together by a flexible tie which passes through it, this tie attaching said portion to said middle part.

A tie attaching the links of a bracelet to each other and also being used for the attachment of the bracelet to the watch case are disclosed in several documents.

A bracelet-watch including a plurality of elements articulated one after the other is disclosed in the document EP-A-0 167 891. One of these elements carries a timepiece and the other elements constitute the links of the bracelet. The elements are encased end to end and held together by means of two flexible non-extending ties which pass through channels formed in each of the elements and arranged on either side of the longitudinal axis of the bracelet-watch. The bracelet-watch also includes at each of the ends of the bracelet, an end part provided with means for fastening said flexible tie. The elements can be made of a synthetic material charged with carbon fibres and the ties can be made of a synthetic material impregnated with graphite. In this construction, each of the ties is fastened to the end of one of the bracelet portions, passes through the first portion, then the middle part of the case and finally through the second portion to be fastened to the end of this second portion. This construction raises problems as regards passing the tie along the length of the case and particularly at the place through which the time-setting crown passes.

The documents CH-A-490 827 and FR-A-2 036 330 also use a tie for attaching the links to each other and for attaching the bracelet portion thereby formed to the watch case. Here, a flexible cable goes from an end part of one bracelet portion, along this portion to the articulation bar connecting two horns of the case to the watch, passes inside the bar, then comes back along the same bracelet portion to be fastened finally to the same end part. This construction raises manufacturing problems as regards the passage of the bar. It will also be noted that the traction force exerted by the bracelet on the case is borne entirely by the bar which is a mechanically fragile part and which can break all the more easily since it is weakened by the passage of the cable.

The Utility Model DE-G-85 34 115.0 discloses a bracelet-watch formed of links having concave flanks and which have transverse holes. It also includes bars of circular section which are encased in the concave flanks of said links. A cable passes through the holes arranged in these links and bars. The cable is U-shaped, the ends being held in the middle part of the watch case, by means of screws. This construction raises a problem as regards the fastening or fixing via screws of the cable in the middle part. If a fixing via screws is provided for, the problem as regards the cable tension, which is much less easy to realise in a middle part than in an end link, is also raised. Finally, a fixing via screws to the middle part is detrimental to the aesthetic appearance of the watch case.

In order to overcome the inadequacies or drawbacks which are raised by the aforecited documents, the present invention is characterized in that the tie is fixed via its first end to a final link of the bracelet portion to pass first, into first holes, through the links and bars constituting said portion and in that the tie then passes into the middle part then comes out again to pass finally, into second holes, through the same links and bars in order to be fixed, via its second end, to said final link of said bracelet portion.

The advantages and the interest of such an invention will be explained now in detail with the help of the following description of an embodiment and the drawings which illustrate it by way of non-limiting example and in which.

Figure 2:
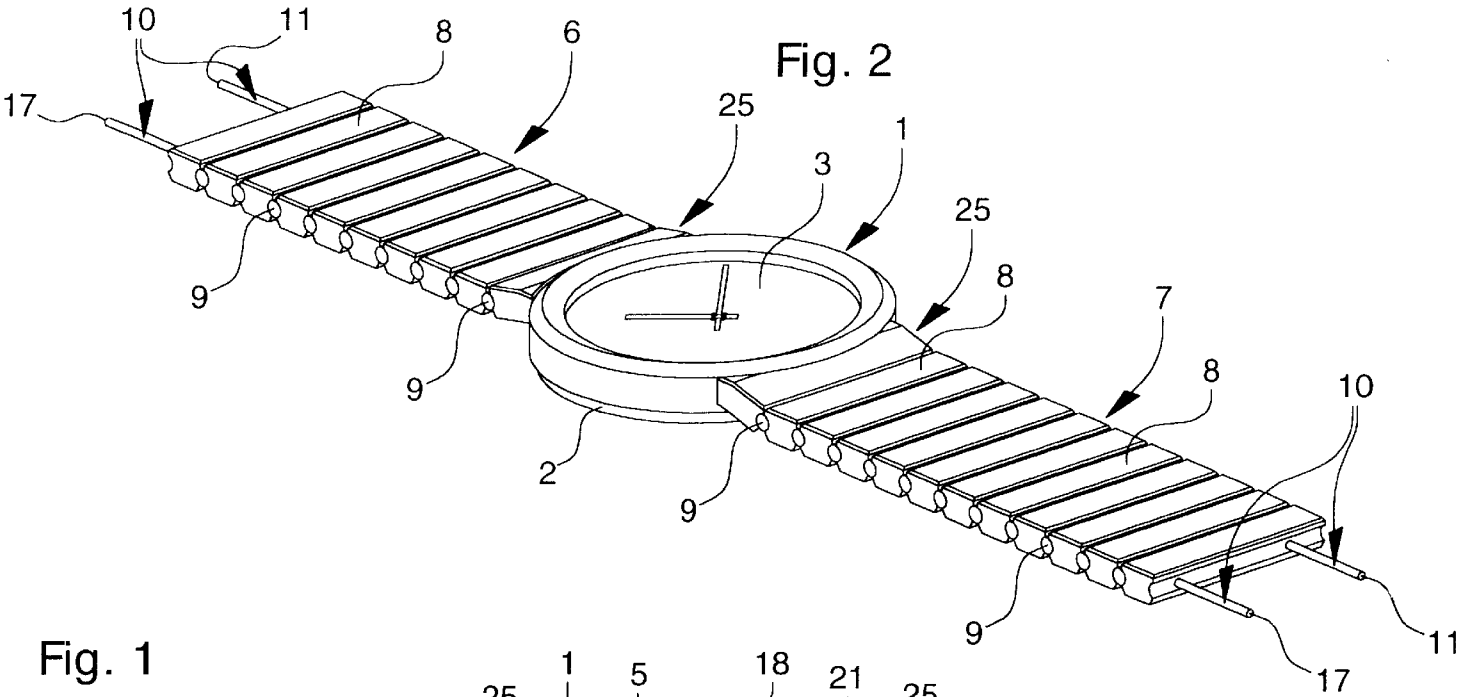
FIG. 2 is a perspective view of the top of the bracelet-watch of FIG. 1, the final links having been removed.
Figure 1:
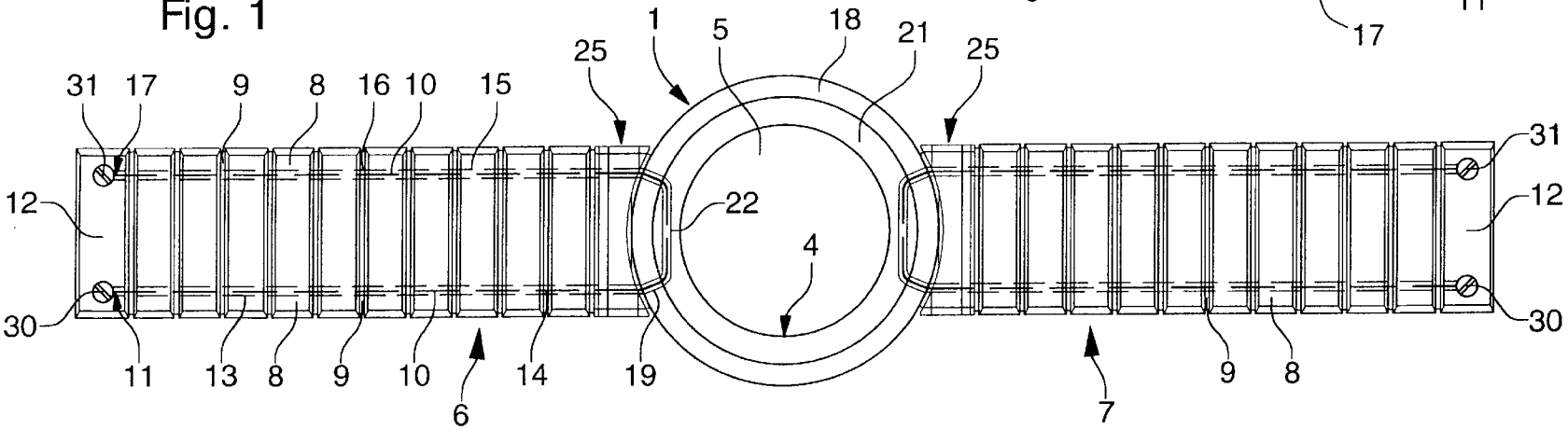
FIG. 1 is a bottom view of the bracelet-watch according to the invention showing the path of the tie through the bracelet and the case.

As can be seen in FIGS. 1 and 2, the bracelet-watch of the invention includes a case 1 which itself includes a back cover 2, a crystal 3 and a middle part 4. Middle part 4 surrounds a movement 5. This bracelet-watch includes a first bracelet portion 6 and a second bracelet portion 7 both of which are attached to case 1. Each of these bracelet portions is formed of links 8 which are articulated one after the other via cylindrical bars 9 inserted between links 8. Links 8 and bars 9 of each of portions 6 and 7 are held together by a cable or flexible tie 10 which passes through said links and bars. This flexible tie 10 also attaches each of the bracelet portions to middle part 4. FIG. 1 intentionally shows tie 10 in each of bracelet portions 6 and 7.

According to the present invention and as shown in FIG. 1, in bracelet portion 6, tie 10 is fixed at its first end 11 to a final link 12 of bracelet portion 6. This tie passes first through a series of first holes 13 and 14 made respectively in links 8 and bars 9 constituting bracelet portion 6. Tie 10 then passes into middle part 4 and out again in order finally to pass through a series of second holes 15 and 16 made respectively in the same links 8 and the same bars 9 of bracelet portion 6. The second end 17 of tie 10 is fixed to final link 12. It can be seen that bracelet portion 7 is made in the same manner.

FIG. 2, which does not reveal the path of ties 10 into bracelet portions 6 and 7, shows bracelet ends without final links 12. Only ends 11 and 17 of tie 10 which are intended to be fixed to said final links project from portions 6 and 7. This FIG. 2 is in perspective in order to give a general idea of the appearance of the bracelet-watch.

With reference again to FIG. 1, it is seen that final link 12 is provided with two screws 30 and 31 which are used respectively to fix ends 11 and 17 of tie 10. A more detailed description of such fixing can be found in aforecited document EP-A-0 167 891. It will be noted that, in this document, the screws for fixing the tie end in a bowl shape which jag the tie and hold it firmly in place. In order to stretch the tie, the first end 11 thereof is first fixed by means of screws 30. By means of pliers, second end 17 is then pulled until all of links 8 and bars 9 are joined and bracelet portion 6 applies against middle part 4. Once this is done, screw 31 is screwed in to block tie 10. It will also be noted that final links 12 can include means for the connection thereof to a clasp or can themselves constitute elements directly forming part of the clap.

Figure 3:
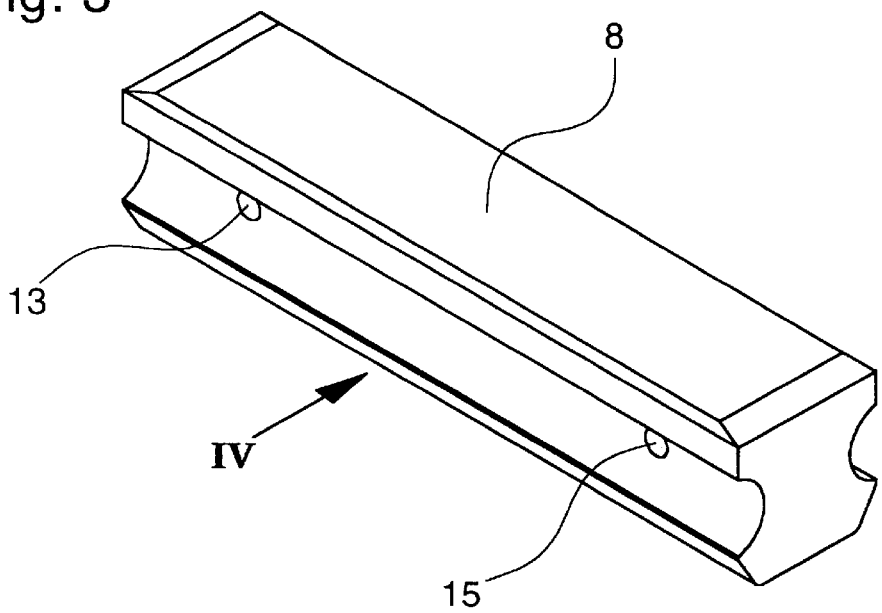
FIG. 3 is a perspective view of the link forming the bracelet.
Figure 4:
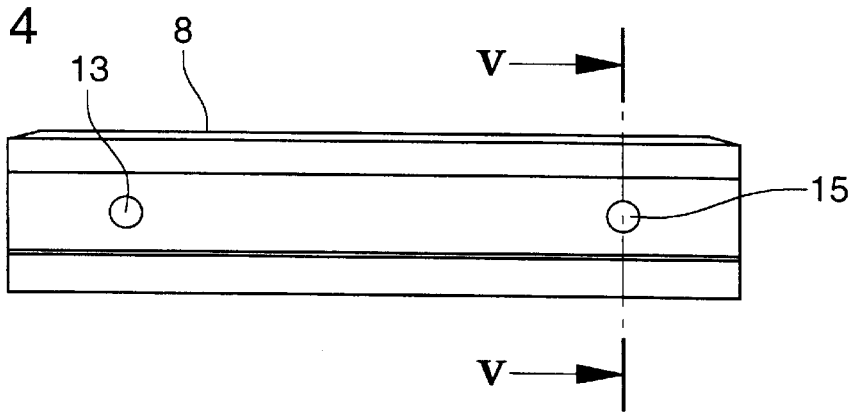
FIG. 4 is a view along the arrow IV of FIG. 3.
Figure 5:
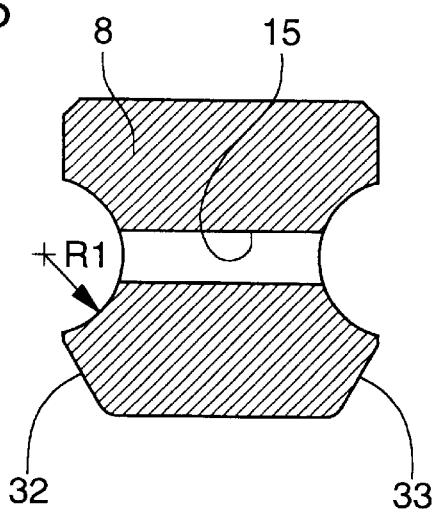
FIG. 5 is a cross-section along the line V—V of FIG. 4.

The bracelet is formed of an alternation of links 8 and bars 9. A link is shown in perspective in FIG. 3. A view along the arrow IV of FIG. 3 is shown in FIG. 4 and a cross-section along the line V—V of FIG. 4 is shown in FIG. 5. Link 8 is pierced with two holes 13 and 15 into which the tie passes. The flanks of the link are profiled in the shape of an arc of a circle of radius R1 each of which will accommodate a cylindrical bar 9.

The lower part of the link includes two reliefs 32 and 33 which will allow the bracelet to bend to match the shape of the wearer's wrist.

Figure 6:
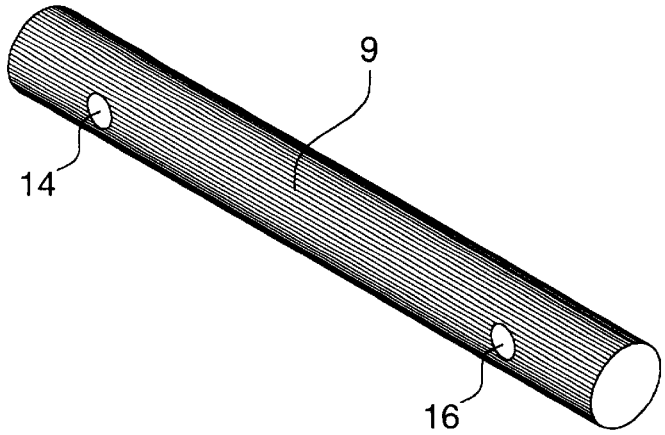
FIG. 6 is a perspective view of the bar forming the bracelet.
Figure 7:
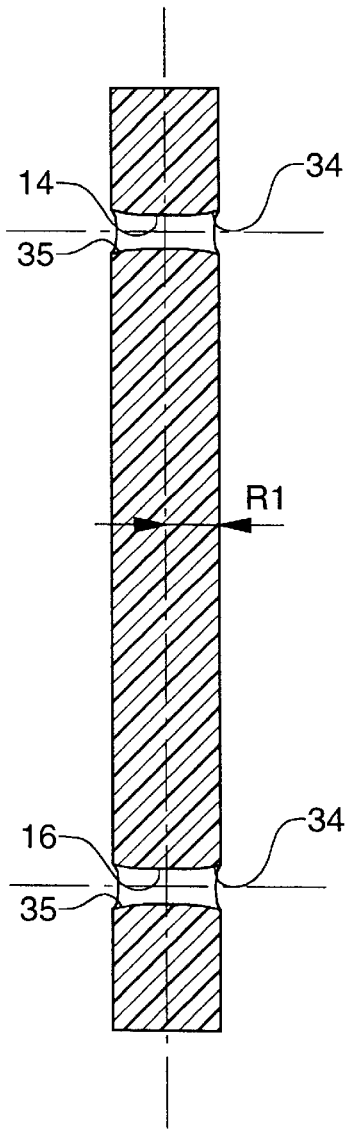
FIG. 7 is a cross-section along the length of the bar shown in FIG. 6.

A bar 9 is shown in perspective in FIG. 6 and a cross-section along the length of this bar is shown in FIG. 7. Bar 9 is pierced with two holes 14 and 16 into which the tie passes. Radius R1 of the bar is the same as that of the arc of a circle made in link 8. It will be noted in FIG. 7 that the entry 34 and exit 35 of holes 14 and 16 are flared, which allows tie 10 to be bent when the bracelet is bent.

If links 8 are made of metal, the bars will preferably be made of a plastic material of slightly elastic consistence, which allows a good level of tension of the tie, and thus a good application of the links against the bars, which prevents openings appearing between them.

As FIG. 1 also shows, the entry of tie 10 into middle part 4 is achieved by a passage 19 and its exit by a passage 20, these passages being made in a ring 18 forming middle part 4. If this ring is metallic, for example made of steel, the watch case will be able to resist perfectly the traction stress exerted thereon and this single ring will be sufficient to form the middle part. However, depending upon the material used, for example plastic or a friable mineral material, the traction force exerted on the case could damage the case or break it. In order to avoid this, the arrangement which will be explained hereinafter has been provided.

Figure 8:
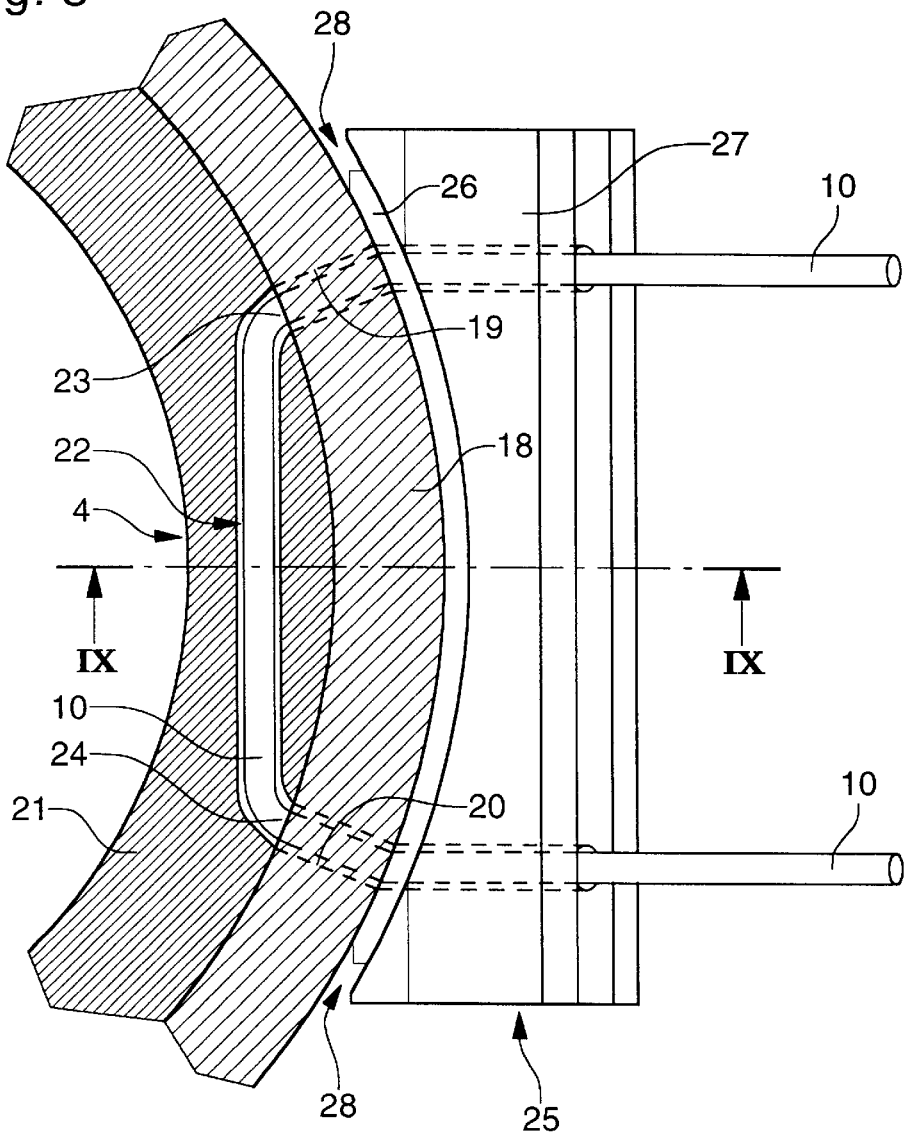
FIG. 8 is a partial bottom view of the case from which the back cover has been removed.

As shown in FIGS. 1 and 8, middle part 4 includes an outer ring 18 in which a first passage 19 is made for accommodating tie 10 as it enters and a second passage 20 is made for accommodating tie 10 as it exits. The middle part also includes an inner ring 21 in which a channel 22 is made. The beginning 23 of this channel 22 coincides with first passage 19 and the end 24 of this channel 22 coincides with second passage 20. Thus tie 10 enters via passage 19 made in outer ring 18, follows channel 22 of inner ring 21 in which it is housed and exits via passage 20 made in outer ring 18. In this construction, it will be understood that the traction is exerted on inner ring 21 and that outer ring 18 is not stressed. If outer ring 18 is made of a mineral material for example, the inner ring will be made of metal, brass or titanium for example. Passages 19 and 20 made in outer ring 18 can be simple holes. They could also be open recesses, which are then covered by the back cover of the case.

Figure 9:
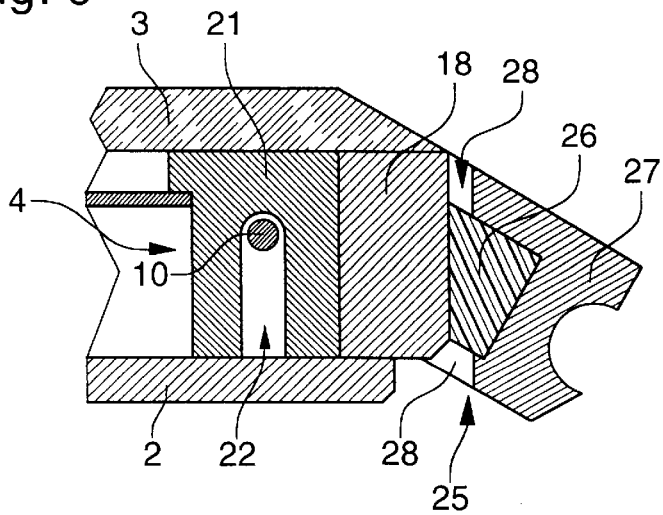
FIG. 9 is a cross-section along the line IX—IX of FIG. 8, the back cover of the case having been replaced.

As FIGS. 1 and 2 show, bracelet portions 6 and 7 are applied simply and directly against case 1 via an end link 25. In the event that the case and the end link are made of the same material, for example steel, there will be a risk that the case is scratched by the end link, since the bracelet is held against case 1 only by tie 10, the end link being consequently subject to small movements. In order to avoid this drawback, FIGS. 8 and 9 show a construction which will now be explained in conclusion.

End link 25 includes an end portion 26 which is directly in contact with middle part 4 or more precisely with outer ring 18 of this middle part 4, and a cap 27 covering said end portion. A space 28 is arranged between ring 18 and cap 27. It will be understood that this arrangement prevents cap 27 coming into contact with ring 18. If cap 27 is made of metal, like the following links 8, and if ring 18 is also made of metal and if the end portion is made of a plastic material, there will be no risk of ring 18 being scratched by cap 27, since there is no contact between the ring and the cap.

What is claimed is:

1. A bracelet-watch comprising a case including a back cover, a crystal and a middle part surrounding a movement and two bracelet portions attached to the case, each portion being made by means of links articulated one after the other via cylindrical bars inserted between the links, the links and the bars of each of the portions being held together by a flexible tie which passes through them, said tie attaching said portion to said middle part, wherein the tie is fixed via its first end to a final link of the bracelet portion to pass first, into first holes, through the links and bars constituting said portion and in that the tie then passes into the middle part then comes out again to pass finally, into second holes, through the same links and bars in order to be fixed, via its second end, to said final link of said bracelet portion.

2. A bracelet-watch according to claim 1, wherein the middle part includes an outer ring in which a first passage is made for accommodating the tie as it enters and a second passage is made for accommodating the tie as it exits, and wherein an inner ring in which a channel is made whose beginning and end coincide respectively with said first and second passages, the tie being housed in said channel.

3. A bracelet-watch according to claim 1, wherein each bracelet portion includes an end link which is applied against the middle part by the tension force exerted on the tie, this end link including an end portion which is directly in contact with the middle part and a cap covering said end portion, a space being arranged between the middle part and the cap.

4. A bracelet-watch according to claim 3, wherein the middle part, the cap and the links are made of metal and the end portion is made of a plastic material.

5. A bracelet-watch according to claim 1, wherein the links are made of metal and the bars inserted between said links are made of a plastic material.

* * * * *